United States Patent [19]

Honda et al.

[11] Patent Number: 4,668,283

[45] Date of Patent: May 26, 1987

[54] MAGNETIC POWDER AND PRODUCTION PROCESS THEREOF

[75] Inventors: Tadatoshi Honda, Hiratsuka; Takeshi Tsuda, Samukawamachi, both of Japan

[73] Assignee: Mitsui Toatsu Chemicals, Incorporated, Tokyo, Japan

[21] Appl. No.: 746,884

[22] Filed: Jun. 20, 1985

[30] Foreign Application Priority Data

Jun. 25, 1984 [JP] Japan ..... 59-129208
May 2, 1985 [JP] Japan ..... 60-93765

[51] Int. Cl.[4] ..... C22C 1/04

[52] U.S. Cl. ..... 75/0.5 AA; 148/105; 427/127; 75/251; 428/403

[58] Field of Search ..... 148/105; 75/0.5 AA; 427/127

[56] References Cited

U.S. PATENT DOCUMENTS 2,232,352 2/1941 Verweij et al. ..... 427/127
2,306,198 12/1942 Verweij et al. ..... 427/127
3,558,371 1/1971 Becker ..... 75/0.5 AA
4,155,748 5/1979 Steck et al. ..... 148/105
4,169,802 10/1979 Basile et al. ..... 427/127
4,501,795 2/1985 Takeuchi et al. ..... 427/127

FOREIGN PATENT DOCUMENTS 59-53601 3/1984 Japan ..... 148/105

*Primary Examiner*—John P. Sheehan
*Attorney, Agent, or Firm*—Oblon, Fisher, Spivak, McClelland & Maier

[57] ABSTRACT

Magnetic powder protected from subsequent oxidation and deterioration can be obtained by effecting contact of starting magnetic powder, which is formed of an intermetallic compound containing a rare-earth metal and an iron-group metal as principal components thereof, with a phosphorus compound containing at least one active proton having a pKa of 4 or smaller and exposure of the starting magnetic powder to an oxygen-containing atmosphere in an arbitrary order or simultaneously. Production of a plastic magnet with the magnetic powder of this invention allows to avoid danger and deterioration in magnetic characteristics of the resulting product due to oxidation of the magnetic powder even if exposed to elevated temperatures during its production or use.

5 Claims, No Drawings

MAGNETIC POWDER AND PRODUCTION PROCESS THEREOF

TECHNICAL FIELD

This invention relates to magnetic powder suitable for use in the production of plastic magnets and capable of avoiding deterioration in quality due to its oxidation during the production or use of the plastic magnets and to a production process thereof.

BACKGROUND ART

Plastic magnets are usually produced by kneading magnetic powder having an average particle size in the range of 1–150 μm and a thermosetting resin or a thermoplastic resin and then forming the resultant mixture by a conventional plastic molding method such as compression molding, injection molding or extrusion molding. Different from magnets obtained by sintering or casting, they have such features that they facilitate molding and machining and they enjoy elasticity and chemical resistance.

As magnetic powder for such plastic magnets, ferrite has conventionally been employed. Reflecting the recent trend toward still stronger magnets, it has been attempted to use as magnetic powder fine particles of intermetallic compounds which contain as principal components a rare-earth metal and an iron-group metal (hereinafter called "rare-earth magnets" for the sake of brevity) and which have higher crystallomagnetic anisotropy than ferrite, for example, a rare-earth magnet such as $RCo_5$- or $R_2Co_{17}$-base magnet, R being a rare-earth element, or an Nd-Fe-B-base magnet.

Upon production of a plastic magnet, such magnetic power is exposed to elevated temperatures during its kneading with a resin or during the molding of the resultant mixture. Since particles of a rare-earth magnet are, unlike ferrite, very susceptible to oxidation as mentioned for example in Japanese Patent Laid-open Nos. 16698/1979 and 71031/1979, they are oxidized in the course of their formation into plastic magnets. As a result, there is a problem that the magnetic characteristics of the resultant rare-earth plastic magnets are considerably inferior. In some extreme instances, their oxidation may proceed abruptly in the course of their formation into such plastic magnets, thereby raising another problem from the standpoint of safety.

Even when produced by a method featuring less chance of exposure to elevated temperatures during the production, for example, by a method such as compression molding, certain products may be used near the withstandable temperatures of their binder resins, leading to another problem that the magnetic characteristics of such magnetic powder may be deteriorated with time by their oxidation while they are used.

Many processes have already been proposed to produce rare-earth plastic magnets of high performance. As one of such proposals, it has been known to improve the performance of a magnet, which has been obtained by the powder method, by coating magnetic powder with a phosphorus compound so that the coefficient of the surface friction of the powder is lowered to increase the packing density of the resultant magnet powder in the molded magnet and the orientation thereof (see, for example, Japanese Patent Laid-open No. 26104/1982). This process characterizes the use of a phosphorus compound as a coating agent in lieu of an oil, paraffin, fluorinated resin which has conventionally been used.

A wide variety of phosphorus compounds may be used therein, including compounds between elements making up the magnetic powder and phosphorus, phosphorus-containing organic compounds and phosphorus-containing inorganic compounds. As specific examples, are mentioned manganese phosphate type, zinc phosphate type, iron phosphate type, zinc phosphate/manganese phosphate type, zinc phosphate/calcium phosphate type, etc. They are all well-known as principal components of phosphating or phosphate-pickling solutions for steel sheets. In other words, the above proposed processes feature application of the conventional phosphating or phosphate-pickling process, which have been used for ordinary steel sheets, to magnetic powder.

Magnetic powder produced by each of the above proposed processes is covered with the principal components of a phosphating or phosphate-picking solution as a lubricant thick layer on the surfaces thereof. Consequently, its bulk specific gravity was small and rare-earth plastic magnets obtained by using the powder as a raw material were not fully satisfactory in their performances (see, Comparative Example 4).

DISCLOSURE OF THE INVENTION

The first object of this invention is to provide rare-earth magnetic powder treated in such a way that it can avoid oxidation and deterioration during the production and subsequent use of plastic magnets as well as a production process of such rare-earth magnetic powder.

The second object of this invention is to provide rare-earth magnetic powder useful in the production of high-performance plastic magnets with high bulk specific gravities as well as a production process of such rare-earth magnetic powder.

The above objects of this invention can be attained by using rare-earth magnetic powder as a starting material, bringing it into contact with a phosphorus compound which contains at least one active proton having a pKa of 4 or smaller, and exposing it to an oxygen-containing atmosphere. In the present invention, it is necessary as essential features to bring the starting magnetic powder into contact with the phosphorus compound containing at least one proton having a pKa of 4 or smaller and also to expose it to the oxygen-containing atmosphere. It should be borne in mind that the order of these two steps is absolutely arbitrary.

Namely, the objects of this invention can be achieved by magnetic powder obtained by either one of the following processes: a process in which starting magnetic powder is first of all exposed to an oxygen-containing atmosphere and is then brought into contact with a phosphorus compound containing at least one active proton having a pKa of 4 or smaller; another process in which the starting magnetic powder is exposed to the oxygen-containing atmosphere simultaneously with its contact with the phosphorus compound containing at least one active proton having the pKa of 4 or smaller; and a further process in which the starting magnetic powder is first of all brought into contact with the phosphorus compound containing at least one proton having the pKa of 4 or smaller and is then exposed to the oxygen-containing atmosphere.

BEST MODES FOR CARRYING OUT THE INVENTION

As rare-earth magnetic powder useful as starting magnetic powder in the practice of this invention, may be mentioned those known conventionally as raw materials for the production of plastic magnets, for example, such rare-earth magnetic powder as described inter alia in Japanese Patent Laid-open Nos. 16698/1979, 71031/1979, 26104/1982 and 46008/1984. They may, for example, be rare-earth magnetic powder, each of which contains a rare-earth metal such as Sm, Pr, Ce, La or Nd, and Fe or Co as principal components thereof and in addition, Ni, Cu, Mn, Cr, Ti, Zr, Al, B and/or the like as needed. Illustrative of such rare-earth magnetic powder may include $SmCo_5$ magnetic powder formed of 33 wt. % Sm and 67 wt. % Co, $Sm_2Co_{17}$-base magnetic powder formed of 25.6 wt. % Sm, 14.7 wt. % Fe, 7.7 wt. % Cu, 1.9 wt. % Zr and the remainder Co, Fe-Nd-B-base magnetic powder formed of 64 wt. % Fe, 2 wt. % B and 34 wt. % Nd, and these analogues.

The average particle size of such rare-earth magnetic powder may vary depending on its composition, end use, etc. In general, it may suitably range from 0.5 to 150 μm, or notably from 1 to 100 μm.

In the present invention, fine particles of a rare-earth magnet is brought into contact with a phosphorus compound containing at least one active proton having a pKa of 4 or smaller, for example, phosphoric acid, an acidic phosphoric ester, a dialkyl dithiophosphate, phosphorous acid, an acidic phophorous ester, or the like. As exemplary acidic phosphoric esters, may be mentioned monomethyl phosphate, dimethyl phosphate, monoethyl phosphate, diethyl phosphate, monoisopropyl phosphate, diisopropyl phosphate, mono-n-butyl phosphate, di-n-butyl phosphate, monooctyl phosphate, dioctyl phosphate, monooleyl phosphate, dioleyl phosphate, diphenyl phosphate, etc. Illustrative of the alkyl group of the dialkyl dithiophosphate may be methyl group, ethyl group and so on. As exemplary acidic phosphorous esters, may be mentioned dimethyl phosphite, diethyl phosphite, diisopropyl phosphite, di-n-butyl phosphite, dioctyl phosphite, didodecyl phosphite, dilauryl phosphite, dioleyl phosphite, diphenyl phosphite and the like. As method for bringing the starting magnetic powder into contact with either one of these phosphorus compounds, the starting magnetic powder may be dipped in a solution of the phosphorus compound, may be sprayed with a solution of the phosphorus compound or may be brought into contact with vapor of the phosphorus compound. Here, the suitable concentration of the phosphorus compound in the solution employed for dipping or spraying may generally range from 0.1–20 wt. %. As its solvent, any desired solvent such as water, an alcohol or the like may be employed. The contact between the starting magnetic powder and the phosphorus compound may be effected at temperatures ranging from room temperature to 100° C. The contact time may generally range from 5 minutes to 10 hours.

In the present invention, the starting rare-earth magnetic powder is exposed to an oxygen-containing atmosphere either before or after or even simultaneously with its contact with the phosphorus compound. The oxygen content in the atmosphere may be at any level so long as it is 1.0% by volume or higher. Usually, it is hence only necessary to expose the starting magnetic powder to the air.

The time for which the starting magnetic powder is exposed to the oxygen-containing atmosphere may vary within a wide range, depending on the composition of the rare-earth magnet, the degree of its crystalline growth, its average particle size, the oxygen concentration in the atmosphere, temperature and the type and concentration of the phosphorus compound. It may generally range from 5 minutes to 10 hours.

When the starting magnetic powder is exposed to the oxygen-containing atmosphere simultaneously with its contact with the phosphorus compound, the process may be advantageously effected under such conditions that are employed upon bringing the starting magnetic powder into contact with the phosphorus compound. When exposing the starting magnetic powder to the oxygen-containing atmosphere either before or after its contact with the phosphorus compound, it is suitable to effect its exposure to the phosphorus compound at 50°–250° C. or more preferably at 70°–200° C.

The present invention will hereinafter be described more specifically by the following Examples.

EXAMPLE 1

After exposing an $Sm_2Co_{17}$-base starting magnetic powder (particle sizes: 44–63 μm), which was formed of 25.6% Sm, 14.7% Fe, 7.7% Cu, 1.9% Zr and the remainder Co, to air at 190° C for 30 minutes, it was dipped at room temperature for 30 minutes in a 0.5 wt. % aqueous solution of phosphoric acid. The thus-treated magnetic powder was washed with water and was then dried. Ninety parts of the magnetic powder and 10 parts of a nylon-base resin were heated and kneaded at 270° C. and were then heated to 310° C. It was injected under a magnetic field having a magnetic field strength of about 16,000 oersted into a mold which had been cooled to 120° C, thereby producing a rare-earth plastic magnet sample of 7 mm in diameter and 4.5 mm in height. Its magnetic characteristics are shown in Table 1.

EXAMPLES 2–6 AND COMPARATIVE EXAMPLES 1–3

Samples were prepared in the same manner as in Example 1 except that the pre-treatment conditions for the powder were modified as indicated in Table 1. The magnetic characteristics of the resultant plastic magnet samples are also given in Table 1.

TABLE 1

| Ex. or comp. Ex. No. | Treatment conditions for magnetic powder: Exposure conditions temp. (°C.) | Exposure conditions time (min) | Type of phosphorus compound | Contact conditions temp. (°C.) | Contact conditions time (min) | Magnetic characteristics of plastic magnet: Residual flux density Br (KG) | Coersive force BHc (KOe) | Maximum energy product $(BH)_{max}$ (MGOe) |
|---|---|---|---|---|---|---|---|---|
| Ex. 1 | 190 | 30 | 0.5 wt. % phosphoric acid aq. soln. | room temp. | 30 | 5.6 | 4.1 | 6.9 |
| Ex. 2 | 150 | 30 | 0.5 wt. % | 60 | 30 | 5.7 | 4.2 | 7.1 |

TABLE 1-continued

| Ex. or comp. Ex. No. | Treatment conditions for magnetic powder: Exposure conditions temp. (°C.) | Exposure conditions time (min) | Type of phosphorus compound | Contact conditions temp. (°C.) | Contact conditions time (min) | Magnetic characteristics of plastic magnet: Residual flux density Br (KG) | Coersive force BHc (KOe) | Maximum energy product $(BH)_{max}$ (MGOe) |
|---|---|---|---|---|---|---|---|---|
| Ex. 3 | 150 | 30 | phosphoric acid aq. soln. 10 wt. % acidic dibutyl phosphate soln. in methanol | room temp. | 60 | 5.7 | 4.2 | 7.1 |
| Ex. 4 | 150 | 30 | 10 wt. % dimethyl dithiophosphate soln. in methanol | room temp. | 30 | 5.7 | 4.1 | 7.0 |
| Ex. 5 | 150 | 30 | 5 wt. % phosphorous acid soln. in methanol | room temp. | 30 | 5.8 | 4.2 | 7.2 |
| Ex. 6 | 150 | 30 | 5 wt. % phosphorous acid soln. in isopropanol | 50 | 30 | 5.8 | 4.2 | 7.2 |
| Comp. Ex. 1 | None | None | 0.5 wt. % phosphoric acid aq. soln. | 60 | 30 | 5.1 | 2.9 | 5.8 |
| Comp. Ex. 2 | 150 | 30 | None | None | | 5.1 | 2.9 | 5.8 |
| Comp. Ex. 3 | None | None | None | None | | 5.1 | 2.9 | 5.8 |

EXAMPLE 7

XRF (X-ray fluorescence) data of magnetic powder obtained by subjecting starting magnetic powder of the same type as that used in Example 1 to the same exposure treatment and phosphorus compound treatment as those effected in Example 1 were as follows: Sm, 50885 (cps); Co, 288608 (cps); Fe, 8913 (cps); Mn, 54 (cps); and P, 10292 (cps). The bulk density of this powder was 2.589 g/cm$^3$ Ninety seven parts by weight of the above powder and 3 parts by weight of an epoxy resin (with a hardening agent) were mixed and was then molded by a compression molding machine. After heating and hardening the thus-molded mass at 130° C for 30 minutes, the resultant piece was magnetized at a magnetic flux density of 0.93 KG. Before hardening, it showed a magnetic flux density of 0.93 KG. No significant difference was observed when compared with the magnetic flux densities of plastic magnets immediately after their production in a Referential Example, which will be given herein.

COMPARATIVE EXAMPLE 4

A portion of the starting magnetic powder used in Example 1 was chemically treated at 90° C for 10 minutes with a phosphating solution which consisted of 2.0 parts by weight of $Mn(H_2PO_4)2$, 0.5 part by weight of $Mn(NO_3)_2\ 6H_2O$, 0.1 part by weight of $Fe(H_2PO_4)_2$, 0.2 part by weight of $H_3PO_4$ and 17.2 parts by weight of $H_2O$. XRF data of the thus-obtained magnetic powder were as follows: Sm, 36998 (cps); Co, 211492 (cps); Fe, 10337 (cps); Mn, 36385 (cps); and P, 70861 (cps). The bulk density of this powder was 1.771 g/cm$^3$. This powder was molded, hardened and magnetized in the same manner as as in Example 7. The magnetic flux density of the thus-obtained plastic magnet was 0.64 KG, which was found to be significantly lower than that of the plastic magnet obtained in the following Referential Example.

REFERENTIAL EXAMPLE

Starting magnetic powder of the same type as that employed in Example 7 was, without any pre-treatment, molded, hardened and magnetized in the same manner as in Example 7. The magnetic flux density of the resultant plastic magnet was 0.92 KG immediately after its production. Its magnetic characteristics were however deteriorated due to oxidation in the course of its application (see, Comparative Example 7 which will be given herein.).

EXAMPLE 8

Starting magnetic powder of the same type as that used in Example 1 was dipped at room temperature for 30 minutes in a 0.5 wt. % aqueous solution of phosphoric acid. After washing the thus-dipped magnetic powder with water, it was exposed to the air at 90° C. for 30 minutes. A plastic magnet was produced from this resultant magnetic powder by the same manner in Example 7. The thus-obtained magnet was subjected to a 800-hrs. temperature characteristic test in air of 140° C. After the test, its magnetic flux density was 0.90 KG.

EXAMPLE 9

An experiment was carried out following the procedure of Example 8 except that a 5 wt. % methanol solution of phosphorous acid was used in place of the 0.5 wt. % aqueous solution of phosphoric acid. The magnetic density of the resultant plastic magnet was 0.92 KG.

EXAMPLE 10

Starting magnetic powder of the same type as that employed in Example 1 was dipped at 50° C. for 2 hours in a 10 wt. % methanol solution of acidic dimethyl phosphate in the atmosphere of air, followed by its drying. Ninety seven parts by weight of the thus-treated powder and 3 parts by weight of a mixture of an epoxy resin and a hardening agent were mixed, compression-molded, heated and hardened at 130° C. for 30 minutes, and magnetized. The thus-obtained magnet was subjected to a 800-hrs. temperature characteristic test in air of 140° C. After the test, its magnetic flux density was 0.89 KG.

COMPARATIVE EXAMPLE 5

The procedure of Example 8 was followed except that the exposure treatment was skipped. The magnetic flux density of the resultant magnet after its temperature characteristic test was 0.79 KG.

COMPARATIVE EXAMPLE 6

The procedure of Example 8 was followed except that the dipping in the aqueous solution of phosphoric acid was skipped. The magnetic flux density of the resultant magnet after its temperature characteristic test was 0.75 KG.

COMPARATIVE EXAMPLE 7

The procedure of Example 8 was followed except that the dipping in the aqueous solution of phosphoric acid and the exposure treatment were skipped. The magnetic flux density of the resultant magnet after its temperature characteristic test was 0.75 KG.

EXAMPLE 11

After exposing a $Sm_2Co_{17}$-base magnetic powder (particle sizes: about 3–60 μm), which consisted of 25.6% Sm, 14.7% Fe, 7.7% Cu, 1.9% Zr and the remainder Co, to air at 120° C. for 60 minutes, the resultant magnetic powder was dipped at room temperature for 5 hours in a 3.0 wt. % ethanol solution of phosphorous acid. It was then washed with ethanol, followed by its drying. Ninety five parts by weight of the thus-obtained powder and 5 parts of a mixture of an epoxy resin and a hardening agent were mixed, compression-molded, heated and hardened at 150° C. for 20 minutes, and then magnetized.

The thus-obtained rare-earth plastic magnet sample was subjected to a 1000-hrs. temperature characteristic test in air of 120° C. As a result, the magnetic flux density of the sample after the test was 0.93 KG.

EXAMPLE 12

$Sm_2Co_{17}$-base magnetic powder of the same type as that used in Example 11 was exposed to air at 150° C. for 60 minutes, followed by its dipping at room temperature for 10 hours in a 7.0 wt. % methanol solution of diethyl phosphite. The thus-treated powder was then washed with methanol, followed by its drying. The resultant powder was then formed into a rare-earth plastic magnet under the same conditions as those employed in Example 11.

The thus-obtained magnet was subjected to a 1000-hrs. temperature characteristic test in air of 120° C. After the test, its magnetic flux density was 0.90 KG.

COMPARATIVE EXAMPLE 8

The procedure of Example 11 was followed except for the exclusion of the exposure treatment. The magnetic flux density of the resultant magnet was 0.70 KG after its temperature characteristics test.

EXAMPLE 13

After exposing Fe-Nd-B-base magnetic powder (particle sizes: 44–63 μm), which consisted of 64.0 wt. % Fe, 2.0 wt. % B and 34.0 wt. % Nd, to air at 90° C. for 30 minutes, the magnetic powder was dipped in a 0.5 wt. % aqueous solution of phosphoric acid at room temperature for 30 minutes. It was then washed with water, followed by its drying in the air. Ninety seven parts by weight of the thus-treated powder and 3 parts by weight of an epoxy resin (with a hardening agent) were mixed, compression-molded, heated and hardened at 130° C for 30 minutes, and then magnetized. The thus-obtained magnet was subjected to a 800-hrs. temperature characteristic test in air of 100° C. After the test, its magnetic flux density was 0.78 KG.

COMPARATIVE EXAMPLE 9

The procedure of Example 13 was followed except for the exclusion of the exposure treatment and phosphoric acid treatment. After the temperature characteristics test, the magnetic flux density of the resultant magnet was 0.52 KG.

Use of rare-earth magnetic powder treated by the process of this invention for rare-earth plastic magnets can avoid any substantial magnetic powder oxidation in the course of production and subsequent application of the rare-earth plastic magnets. Therefore, rare-earth plastic magnets having high magnetic characteristics can be produced both safely and easily.

We claim:

1. A process for producing magnetic powder protected from subsequent oxidation and deterioration, which comprises, in an arbitrary order, bringing magnetic powder formed of an intermetallic compound, which contains a rare-earth metal and an iron-group metal as principal components thereof, into contact with a phosphorus compound containing at least one active proton having a pKa of 4 or smaller, and exposing the magnetic powder to an oxygen-containing atmosphere at a temperature of from 50° to 250° C.

2. A process according to claim 1, wherein the starting magnetic powder is first exposed to the oxygen-containing atmosphere and is then brought into contact with the phosphorus compound.

3. A process according to claim 1, wherein the starting magnetic powder is brought into contact with the phosphorus compound, simultaneously with its exposure to the oxygen-containing atmosphere.

4. A process according to claim 1, wherein the starting magnetic powder is first brought into contact with the phosphorus compound and is then exposed to the oxygen-containing atmosphere.

5. A process according to claim 1, wherein the average particle size of the starting magnetic powder ranges from 1 to 150 μm.

* * * * *